United States Patent [19]

Wright et al.

[11] Patent Number: 4,919,594

[45] Date of Patent: Apr. 24, 1990

[54] COMPOSITE MEMBER, UNITARY ROTOR MEMBER INCLUDING SAME, AND METHOD OF MAKING

[75] Inventors: E. Scott Wright, Mesa; James G. Kenehan, Phoenix, both of Ariz.

[73] Assignee: Allied-Signal Inc., Morris Township, Morris County, N.J.

[21] Appl. No.: 320,744

[22] Filed: Mar. 8, 1989

Related U.S. Application Data

[62] Division of Ser. No. 51,000, May 15, 1987.

[51] Int. Cl.[5] ..... F23C 11/00; B23P 17/00

[52] U.S. Cl. ..... 416/230; 416/229 A; 29/527.5; 29/889.21; 29/889.71

[58] Field of Search ..... 416/229 A, 230 R, 244 A, 416/244 R; 29/156.8 B, 156.8 R, 527.5, 527.6, 598

[56] References Cited

U.S. PATENT DOCUMENTS

| | | | |
|---|---|---|---|
| 2,757,901 | 8/1956 | McVeign | 416/244 |
| 2,849,788 | 9/1958 | Creek | 29/156.8 R |
| 3,554,667 | 1/1971 | Wagle | 416/218 |
| 3,554,668 | 1/1971 | Wagle | 416/218 |
| 3,571,901 | 3/1971 | Sara | 416/230 |
| 3,610,777 | 10/1971 | Wagle | 416/218 |
| 3,625,634 | 12/1971 | Stedfeld | 416/218 |
| 3,649,425 | 3/1972 | Alexander | 161/43 |
| 3,656,864 | 4/1972 | Wagle | 416/190 |
| 3,699,623 | 10/1972 | Kreider | 29/156.8 B |
| 3,707,750 | 1/1973 | Klass | 29/156.8 B |
| 3,711,936 | 1/1973 | Athey et al. | 29/475 |
| 3,717,443 | 2/1973 | McMurray et al. | 29/191.4 |
| 3,765,796 | 10/1973 | Stargardter et al. | 416/244 |
| 3,787,141 | 1/1974 | Walsh | 416/244 |
| 4,071,184 | 1/1978 | Carlson et al. | 29/156.8 B |
| 4,492,737 | 1/1985 | Conolly | 29/156.8 R |
| 4,494,287 | 1/1985 | Cruzen et al. | 29/156.8 R |

FOREIGN PATENT DOCUMENTS

| | | |
|---|---|---|
| 1040697 | 10/1953 | France . |
| 976237 | 11/1964 | United Kingdom . |

*Primary Examiner*—Robert E. Garrett
*Assistant Examiner*—Hoang Nguyen
*Attorney, Agent, or Firm*—Terry L. Miller; James W. McFarland; Robert A. Walsh

[57] ABSTRACT

A composite member includes circumferentially extending ceramic fibers in a metallic matrix. A rotor member integrally includes such a ceramic fiber/metal matrix composite member to reinforce a homogeneous remainder portion of the rotor member with respect to centrifugally induced stresses. Method of making are included in the disclosure.

14 Claims, 2 Drawing Sheets

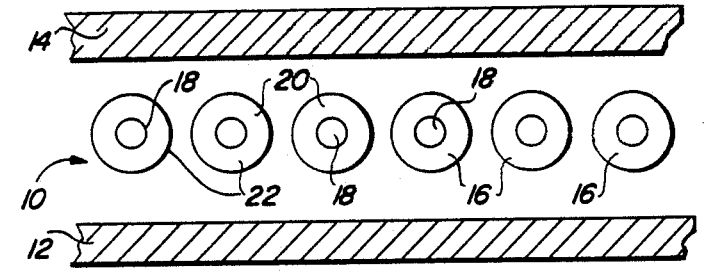
FIG. 1
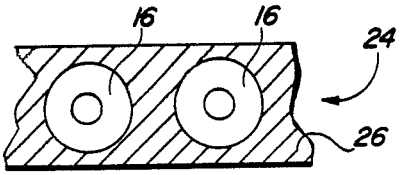
FIG. 2
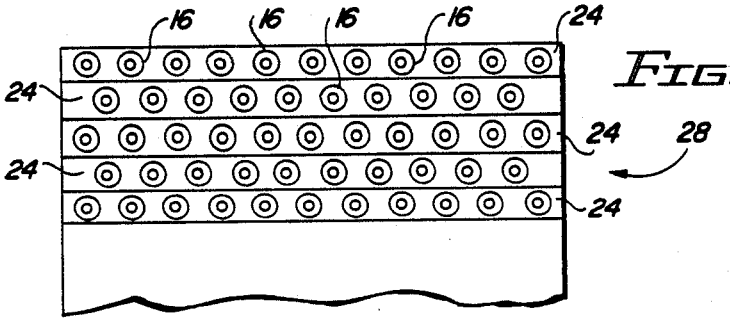
FIG. 3
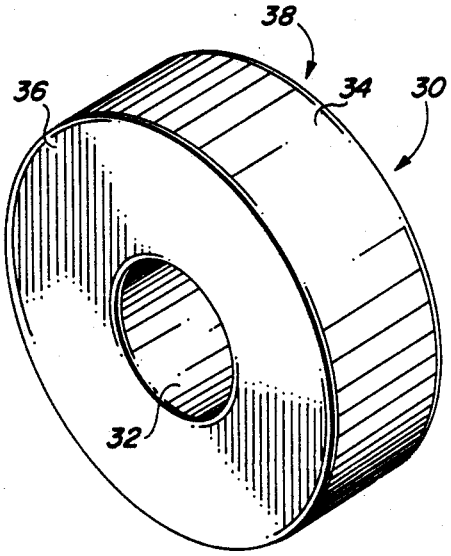
FIG. 4
FIG. 5
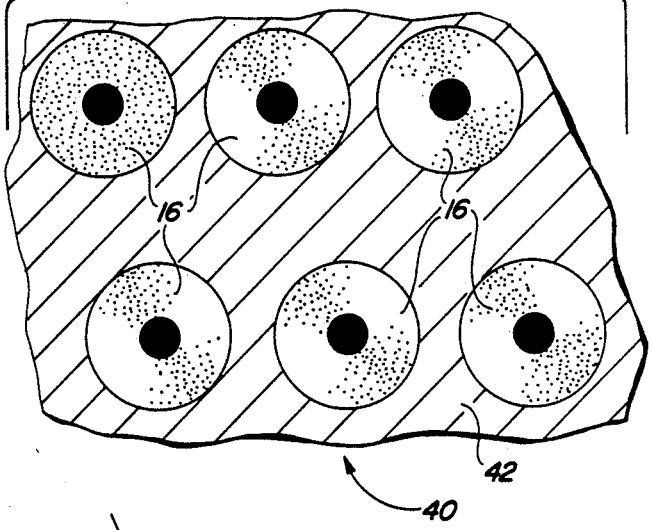
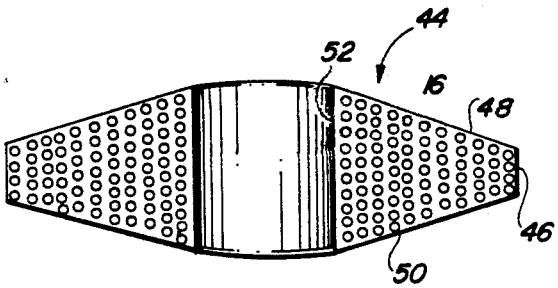
FIG. 7
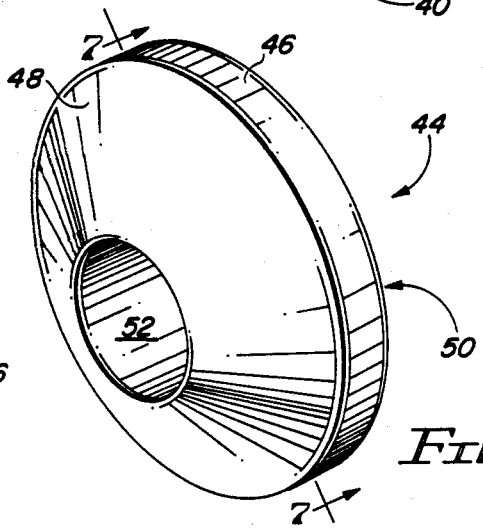
FIG. 6

COMPOSITE MEMBER, UNITARY ROTOR MEMBER INCLUDING SAME, AND METHOD OF MAKING

This is a division of application Ser. No. 051,000 filed May 15, 1987.

BACKGROUND OF THE INVENTION

The field of the present invention is composite ceramic filament/metal matrix members. More particularly, the present invention relates to rotor members for gas turbine engines having composite ceramic filament/metal matrix portions therein. Such a unitary rotor member includes an integral reinforcing portion defined by such a ceramic filament/metal matrix composite member. Still more particularly, the present invention relates to a method of making a ceramic filament/metal matrix composite hoop member. A method of making a unitary rotor member including such a composite ceramic filament/metal matrix hoop reinforcing portion is also disclosed.

Conventional methods of making filament reinforced polymer matrix composite rings is disclosed in U.S. Pat. No. 3,966,523 to Jakobsen et al, issued June 29, 1976. The Jakobsen teaching providing a filament reinforced polymer matrix ring which is intended to remain a separate reinforcing component. Similar conventional teachings are set forth in U.S. Pat. Nos. 3,765,796 and 3,787,141 wherein rotor members for turbine engines are shown to include fiber reinforced composite reinforcing rings. These reinforcing rings are received within annular cavities of the turbine engine rotor member and receive centrifugally induced stresses upon relative radial growth of the metallic components of the rotor member. Although the reinforcing hoop members of composite material may be captured within the rotor member, they remain separate component parts which are subject to relative rotation and vibrational imbalances.

It is understood in the pertinent art that the high tensile strength provided by fiber reinforced composite materials may advantageously be employed to sustain centrifugally induced tangential stresses within a high speed rotor member. However, as is illustrated by the above-outlined conventional teachings, the fiber reinforced composite member has always been considered as a separate reinforcing component which must be supported and restrained within the rotor member of a turbine engine. Such a separate reinforcing component presents many problems with respect to its restraint and support prior to its assuming its full function as a reinforcing member. That is, the metallic components of the rotor member will experience much greater growth in response to centrifugally induced stresses than does the composite member. In order to best utilize such a composite reinforcing hoop, it is therefore required that the metallic components be allowed to sustain a considerable portion of the centrifugally induced stresses and to undergo such radial growth before additional centrifugally induced stresses are transferred to the composite reinforcing hoop member. Thus, prior to the time of assuming its full reinforcing function, the composite hoop member is somewhat free to assume non-concentric positions with respect to the rotational axis of the rotor member. Of course, should the composite reinforcing member deviate significantly from the rotational axis of the rotor member, very significant vibrational forces are sure to result.

An additional aspect of such conventional teachings is that only radially outwardly directed forces may be transferred to the composite member by contact between annular surfaces at the inner bore of the composite hoop member and annular surfaces at an inner wall of the metallic components of the rotor member. Consequently, the metallic components of the rotor member must be designed to sustain significant radially-directed tensile stresses in order to transfer the centrifugally induced tangential stresses to the inner wall portion of the metallic components. Of course, such a design inexorably results in the metallic components of the rotor member being heavier than desired.

SUMMARY OF THE INVENTION

In view of the above, it is an object of the present invention to provide a composite ceramic fiber/metal matrix hoop member wherein the metal matrix of the hoop member is capable of metallurgical integration with the metallic components of a rotor member of a gas turbine engine.

An additional object of the present invention is to provide a unitary rotor member for a gas turbine engine having a composite ceramic fiber/metal matrix reinforcing portion integral therewith.

An additional object of the present invention is to provide a method of making a composite metal matrix ceramic fiber reinforcing hoop member as described above.

An additional object of the present invention is to provide a method of making a unitary rotor member for a combustion turbine engine wherein an integral portion of the rotor member is defined by a ceramic fiber/metal matrix hoop member.

The present invention provides a composite ceramic fiber/metal matrix member wherein a plurality of circumferentially extending ceramic fibers are each continuous circumferentially through at least 360 degrees of arc, and the metal matrix is continuous circumferentially, radially, and axially. That is, the metal matrix is continuous, or monolithic, throughout the entire extent of the composite member.

The present invention further provides unitary or truly one piece, metallic rotor member including as an integral portion thereof, a composite ceramic fiber/metal matrix member as described above. The metal matrix of the composite member is continuous with the metal of the remainder of the rotor member so that the latter is truly of integral metallic continuum, and includes an integral portion having ceramic fibrous reinforcement therein.

Further to the above, the present invention provides a method of making a composite ceramic fiber/metal matrix member including the steps of winding a unidirectional mat of ceramic fibers, laminating the fiber mat with metallic foil, interbonding the foil and ceramic fiber mat, slitting the bonded foil and fiber mat into elongate ribbons, winding the ribbons into a hoop form, consolidating the wound ribbon hoop form into a unitary body, and forming the consolidated unitary body into a determined shape.

The present invention also provides a method of making a unitary or one piece rotor member for a combustion turbine engine having as an integral part thereof a ceramic fiber/metal matrix composite member, and including the steps of forming a composite member as outlined above and further including the additional steps of providing rotor member monolithic components cooperatively defining a cavity of determined shape, assembling the rotor member monolithic components with a composite hoop member having the determined shape captively received in the cavity, consolidating the rotor member monolithic components and the composite hoop member into a unitary body, and further preparing the rotor member for utilization in a combustion turbine engine.

An advantage of the present invention resides in the consolidation of the fibrous reinforcing filaments with the metallic matrix of the composite reinforcing member. That is, the plural fibrous reinforcing members are embedded in the metal matrix in mechanical bonding relationship therewith such that the metal and ceramic fibers are effectively a unitary body. A further advantage of the present invention resides in the unitary nature of a rotor member including a ceramic fiber/metal matrix composite member as outlined above. Such a rotor member advantageously enjoys a continuous metal matrix throughout the member, that is, the metal matrix of the composite is continuous with the monolithic or integral metallic structure of the remainder of the rotor member such that discontinuities and stress concentrations as would be created by conventional constructions are effectively avoided by the present invention. Additionally, because the metallic infrastructure of the rotor member is substantially continuous, centrifugally induced stresses within the rotor member may be transferred to the composite portion thereof by shear and tensile stresses along the radially extending and radially outer axial extents thereof as well as by radially directed compressive forces received adjacent the bore of the composite member. In summary then, a rotor member incorporating a composite member according to the invention enjoys much superior stress transfer to the composite reinforcing hoop and much better utilization of the available strength of the materials of construction that do the best of the known technologies outlined above.

Additional objects and advantages of the present invention will appear from a careful reading of the following detailed description of a single preferred embodiment of the invention taken in conjunction with the following drawing figures.

BRIEF DESCRIPTION OF THE DRAWING FIGURES

FIG. 1 depicts a fragmentary cross-sectional view of an elongate unidirectional ceramic fiber mat and a pair of elongate metallic foils in preparation to lamination thereof into a unitary body;

FIG. 2 depicts a fragmentary cross-sectional view of an elongate composite ceramic fiber/metal matrix ribbon resulting from consolidation of the lamina depicted in FIG. 1;

FIG. 3 shows a fragmentary cross-sectional view of a hoop form resulting from winging onto a mandrel multiple layers of ribbon as depicted in FIG. 2;

FIG. 4 is a perspective view of a hoop form composed of multiple layers of ceramic fiber/metal matrix ribbon as described above, and a closed exterior sheet metal can completely enclosing the wound ribbon hoop form preparatory to HIP processing;

FIG. 5 depicts a fragmentary cross-sectional view of a ceramic fiber/metal matrix hoop form of FIG. 4 and after HIP processing thereof;

FIGS. 6 and 7 show a perspective view and a cross-sectional view, respectively, of a finished ceramic fiber/metal matrix composite member;

DETAILED DESCRIPTION OF THE PREFERRED EMBODIMENT

Figure 8:
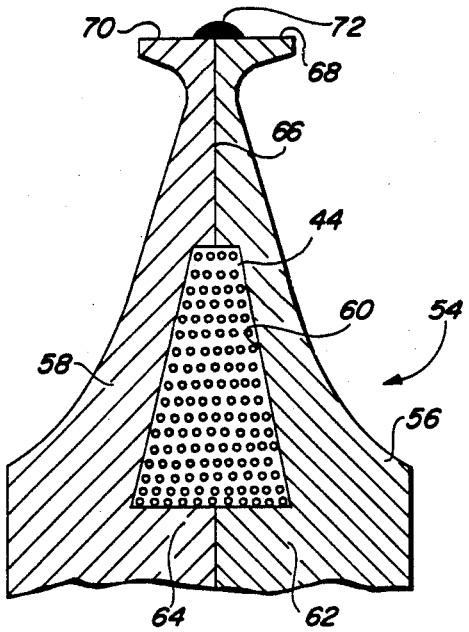
FIG. 8 depicts a fragmentary cross-sectional view of a ceramic fiber/metal matrix member as depicted in FIGS. 6 and 7, received within a cavity defined cooperatively by a pair of metallic rotor member parts.

FIG. 1 depicts a fragmentary cross-sectional view of a unidirectional elongated ceramic fiber mat 10 disposed between a pair of elongate metallic foils 12 and 14 preparatory to lamination of the foils and the ceramic fiber mat. That is, both the mat 10 and foils 12,14 are elongate both perpendicular to the plane of FIG. 1, and laterally. Even though only 6 fibers 16 are shown in FIG. 1, it will be understood that the mat itself contains multiple fibers and preferably is constituted of approximately 130 substantially parallel fibers 16 per inch of width. Each of the fibers 16 is substantially identical and includes a central carbon monofilament core 18 having a diameter of about 0.0013 inch. The core 18 is surrounded by a layer of chemical vapor deposited (CVD) beta silicone carbide 20. Covering the layer 20 of beta silicone carbide is an extremely thin carbon-rich layer 22 having a graded silicone content. By way of example, the layer 22 is preferably only 3 to 4 microns thick and is provided for the purpose of inhibiting high temperature reactivity between the beta silicone carbide layer 20 and the metallic foils 12 and 14. Overall, the filaments 16 have an outer diameter of about 0.0056 inch. Such fibers display a tensile strength of about 550 KSI, a Young's modulous of about 58 PSI (x $10^6$), and a density of about 0.11 pound/$in^3$. A fiber which has been found to be acceptable for this invention is available from Avco Corporation, and is identified as SCS-6 silicon carbide fiber. The metallic foils themselves are composed of a titanium alloy Ti-6A1-4V.

According to the preferred embodiment, the unidirectional fiber mat 10 is constructed by winding onto a large drum multiple substantially parallel wraps of the ceramic fibers 16. That is, the wraps of elongate fiber traverse axially across the drum helically from near one edge thereof to adjacent the other drum edge. An acrylic binder is applied to the drum surface and to the fibers to hold the latter in place after winding. Following curing of the acrylic layer, the fibers and acrylic binder are separated from the drum surface intact as a unidirectional mat. For example, a single axial cut may be made across all of the fiber wraps so that the elongate fibers and acrylic binder are peeled from the drum surface intact as a single sheet. This sheet or mat of acrylic binder and ceramic fibers is then placed between the metallic foils 12 and 14, sealed in a vacuum bag, and press diffusion bonded to form ceramic fiber-metal matrix sheet material. During such press diffusion bonding, the interior of the vacuum bag is evacuated and the temperature increased to about 1000° F. As a result, the acrylic binder is decomposed entirely into gaseous and/or volatile decomposition products, and is removed by the partial vacuum. Subsequently, a combination of pressure, temperature and time are employed to consolidate the foils 12,14 and the fibers 16 into a unitary body. By way of example, a pressure of from 6000 (6 KSI) to 10,000 (10 KSI) and a temperature of from 1650° F. to 1750° F., maintained for a time period of from 20 minutes to 45 minute has proven to be sufficient to interbond the foils 12,14 into a unitary body with the fibers 16.

Viewing now FIG. 2, it will be seen that the resulting ceramic fiber/metal matrix sheet material 24 is composed of approximately 35 percent by volume of fiber 16 with the remainder being constituted by metallic matrix 26. The metallic matrix is composed of the metallic foils 12 and 14 which are metallurgically united by the vacuum diffusion pressing process such that they are integrally interbonded. Even though only a very small transverse section of the sheet material 24 is depicted, in fact, the sheet 24 has a width including several hundreds of the fibers 16 and may be ten feet or more in length. A convenient way of utilizing the sheet material 24 involves making a series of parallel cuts therein, with each cut parallel to the fibers 16. Consequently, each successive cut separates a ribbon-like length of the sheet material 24 from the remainder thereof. The width of the ribbon is selected to match its intended use.

Turning now to FIG. 3, it is seen that an annular hoop form 28 is composed of multiple wraps of ceramic fiber/metal matrix sheet material as depicted in FIG. 2. The sheet material 24 is employed in the form of elongate ribbon produced as described above. The lengths of ribbon may conveniently be wound spirally upon a mandrel (not shown) such that each length of ribbon provides several complete wraps around the mandrel. Consequently, the elongate fibers 16 extend through at least 360 degrees of arc. By way of example, the sheet material 24 may be made by using a winding drum of about four foot diameter. As a result, the sheet material and ribbon has a length of about 12 feet. The outer diameter of hoop form 28 is about 8 inches. Each wrap of hoop form 28 will then require no more than 2 feet of ribbon. Thus, it may be expected that the elongate fibers 16 extend spirally within the hoop form at least 6 complete wraps. The width of the ribbon is equal to that of the hoop form 28 so that wraps of ribbon extend spirally outwardly, but no traversing of the ribbon is necessary in building up the hoop form. Again, in the annular hoop form 28 the overall fiber content is approximately 35 percent by volume with the remainder being defined by the metallic matrix 26.

FIG. 4 depicts an annular hoop form 28 as depicted in FIG. 3 having an annular closed metallic can in surrounding relationship therewith. The annular can includes a radially inner annular axially extending portion 32 and a similar radially outer annular axially extending portion 34. The portions 32 and 34 are connected by a pair of axially spaced-apart radially extending portions 36 and 38. All of the portions 30, 32, 34 and 36 are sealingly interconnected with one another to define a closed annular metallic can surrounding and receiving the annular hoop form 28 previously described.

Following "canning" of the annular hoop form 28 as is depicted by FIG. 4, the resulting assembly is subjected to hot isostatic pressing (HIP) processing to consolidate both the ceramic fiber/metal matrix ribbons 24 of the annular hoop form and the exterior metallic can itself. As a result, a unitary body is formed which is fragmentarily depicted in cross-section in FIG. 5. It is seen in FIG. 5 that the individual discrete ribbons 24 are now integrally interbonded to form a continuous metal matrix having a multitude of circumferentially extending ceramic fibers received therein. Again the bulk of the resulting annular ceramic fiber/metal matrix body is composed of about 35 percent by volume of the ceramic fiber 16 with the remainder being defined by the metal matrix.

FIGS. 6 and 7 in conjunction depict a resulting composite ceramic fiber/metal matrix member which is formed by machining the consolidated body described above. That is, after HIP processing of the canned assembly depicted in FIG. 4, the resulting body appears very much similar to that depicted in FIG. 4 with the exception that the metal matrix is continuous throughout the body and the ceramic fibers are integrally received therein. It will be seen that the annular composite body 44 illustrated in FIGS. 6 and 7 is generally frustroconical in configuration, and includes a plurality of circumferentially extending ceramic fibers 16. The annular body includes an axially extending radially outer surface 46 and a pair of axially spaced apart generally frustroconical radially extending end surfaces 48 and 50. The annular body 44 also defines an axially extending through bore 52.

Turning now to FIG. 8, it will be seen that a disk-like rotor member workpiece 54 is composed of a pair of somewhat similar homogeneous metallic rotor member components 56 and 58 which cooperatively define a recess 60 matching in shape the annular composite ceramic fiber/metal matrix member 44. The components 56,58 are made of titanium alloy Ti-6AL-2SN-4Zr-2Mo (Ti-6242). The annular composite body 44 is received within the cavity 60 such that a pair of boss portions 62 and 64, respectively, of the components 56 and 58 extend into and substantially fill the bore portion 52 of the composite body 44. The rotor member components 56 and 58 also cooperatively define an interface surface 66 extending radially outwardly from the cavity 60 to the radially outer peripheral surfaces 68 and 70 of the components 56 and 58. A circumferentially continuous sealing weld 72 is applied at the junction of the surface 66 with the radially outer peripheral surfaces 68 and 70 to sealingly unite the component pieces 56 and 58 with the composite body 44 captively received within the cavity 60.

Figure 9:
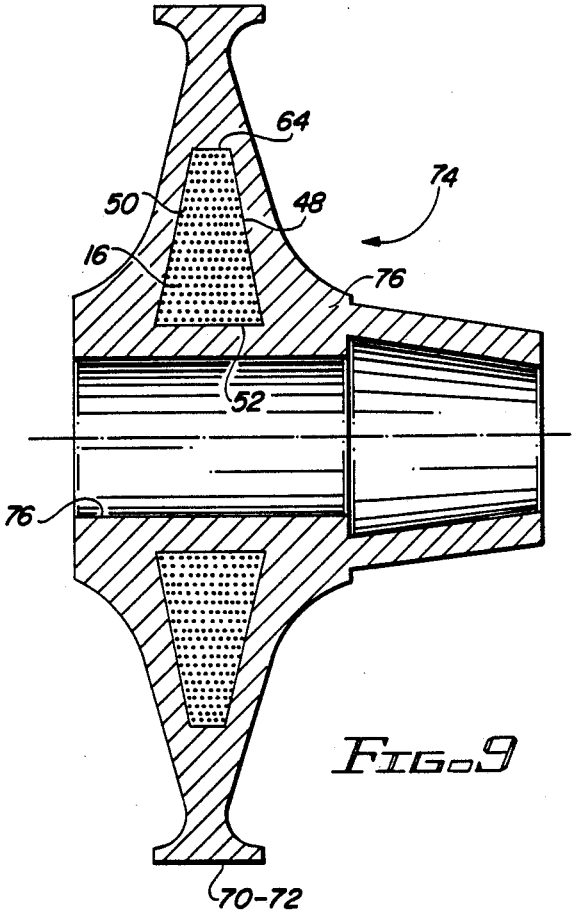
FIG. 9 shows an axial cross-sectional view of a unitary metallic rotor member including as an integral reinforcing portion thereof a ceramic fiber/metal matrix composite.

The assembly depicted in FIG. 8 is subsequently subjected to hot isostatic pressing (HIP) processing to metallurgically unite the components 56 and 58 and the composite body 44. Consequently, the HIP processed workpiece is subjected to further machining operations to results in a substantially completed rotor member 74 as is depicted in FIG. 9. The rotor member 74 defines an axially extending throughbore 76 extending through the bore portion 52 of the composite body 44. The rotor member 74 also is metallurgically continuous to include the metallic matrix of the composite body 44. That is, the metallic material of rotor member 44 is metallurgically integral with the metallic matrix of composite body 44 at the surface of bore 52, at the end surfaces 48 and 50 of the composite body, and at the radially outer surface 46 of the composite body. In point of fact, these surfaces cease to exist after HIP processing of the assembly depicted in FIG. 8. Therefore, the rotor member 44 may be considered to be composed of a continuous metallic matrix or infrastructure having a portion thereof reinforced by circumferentially extending and circumferentially continuous ceramic fibers 16. Further consideration of the completed rotor member will reveal that the metal matrix of the composite portion 44 and the substantially homogeneous metallic structure of the components 56,58 cooperate after HIP processing to define a metallic infrastructure which is continuous throughout the rotor member 74. That is, considered, radially axially, or circumferentially, the metallic structure of rotor member 74 is continuous. Further, the rotor member 74 is free of voids or cavities. At the radially outer peripheral surface (now referenced with the combined reference numerals used previously) 70–72 of rotor member 74, a bladed ring may be attached, or structural features may be provided to carry individual compressor blades, for example.

Figure 10:
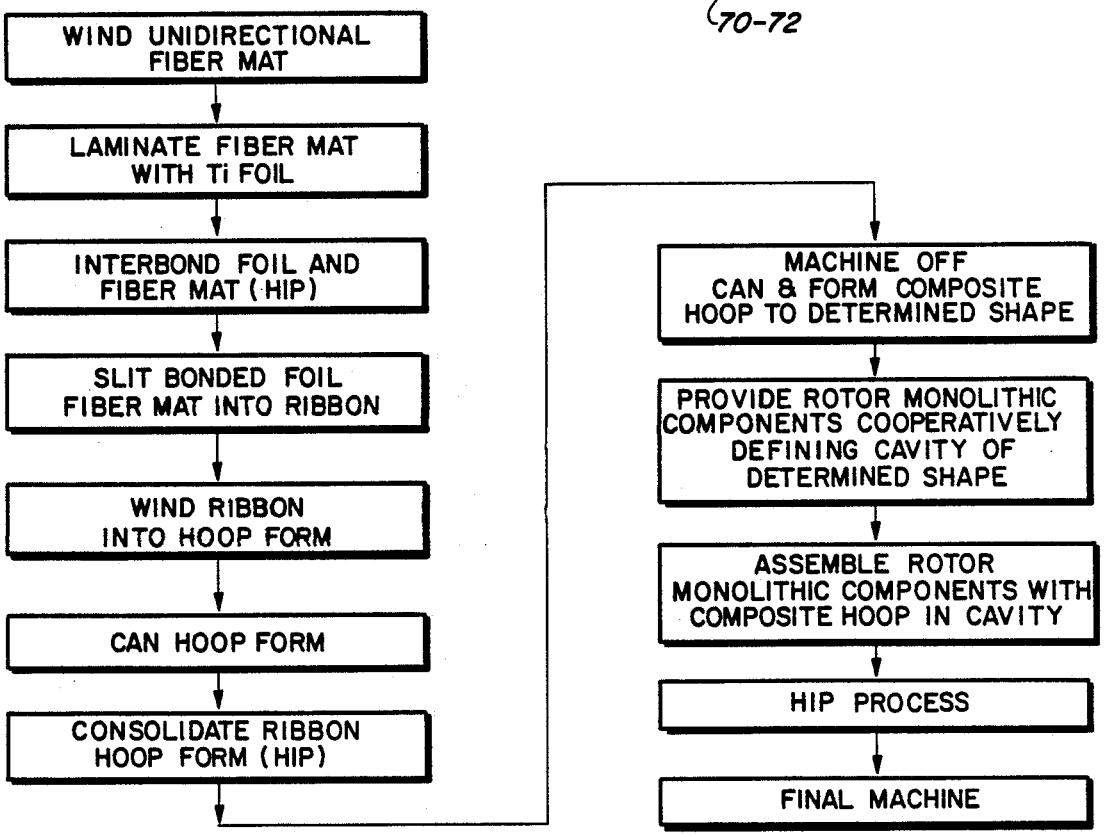
FIG. 10 shows steps in the method of making a ceramic fiber/metal matrix composite member, and a monolithic rotor member integrally including such a composite reinforcing member, according to the invention.

FIG. 10 summarizes the steps in the method of making both the composite body 44, which has been described previously, and the rotor member 74 integrally including such a composite body such as is depicted in FIG. 9. As set forth in FIG. 10, it will be seen that first of all a unidirectional fiber mat is provided by winding ceramic fibers, for example, onto the surface of a drum. The resulting unidirectional fiber mat is laminated with metallic titanium foil and the resulting laminated foil and fiber mat are subsequently consolidated by vacuum diffusion pressing, a species of HIP processing. The resulting composite ceramic fiber/metal matrix foil is then slit into ribbon-like pieces. The ribbons are subsequently wound onto a mandrel to define a composite ceramic fiber/metal matrix hoop form. Such a hoop form is then canned in a closed sheet metal can which is metallurgically compatible with the metallic matrix of the hoop form, and the completed canned assembly is consolidated by HIP processing. Finally, the consolidated canned hoop form is subjected to machining to define a desired outer configuration for the resulting annular composite body. In order to further utilize the resulting annular composite body, rotor member homogeneous monolithic metallic components are provided which define a cavity of the same shape as the annular composite body. An annular composite body is subsequently assembled with the monolithic metallic components of the rotor member and sealed therein such that subsequent HIP processing metallurgically unites the metallic matrix of the composite body with the monolithic metallic components. Final machining of the unitary body resulting from HIP processing then provides a unitary rotor member having an integral reinforcing portion thereof of ceramic fiber/metallic matrix composite.

Having depicted and described our invention by reference to a particularly preferred embodiment thereof with sufficient detail and information provided to allow one ordinarily skilled in the pertinent art to make and use the invention, it is our desire to protect our invention in accord with applicable law. While the invention has been described by reference to a particularly preferred embodiment thereof, such reference does not imply a limitation upon the invention and no such limitation is to be inferred. The invention is to be limited only by the spirit and scope of the appended claims which also provide additional disclosure and definition of the invention.

We claim:

1. The method of making a ceramic fiber/metal matrix composite member of desired annular configuration including the steps of:

providing an elongate unidirectional mat of ceramic filaments;

laminating said unidirectional mat of ceramic filaments between a pair of elongate metallic foils;

consolidating said laminated unidirectional ceramic filament mat with said pair of metallic foils to form an elongate unitary composite ceramic fiber/metal matrix ribbon;

circumferentially winding said elongate ceramic fiber/metal matrix ribbon to define an annular hoop form having multiple layers of said ribbon;

enclosing said annular hoop form in a closed metallic can;

consolidating said hoop form and said metallic can to form a unitary composite workpiece; and forming said workpiece to said desired annular configuration.

2. The method of claim 1 wherein the following additional steps are employed to make a unitary metallic rotor member including as an integral reinforcing portion thereof a composite ceramic fiber/metal matrix member, said steps including:

providing a pair of complementary unitary metallic components cooperatively defining a closed cavity in shape closely matching said ceramic fiber/metal matrix member;

disposing said ceramic fiber/metal matrix member in said cavity;

sealingly uniting said pair of components to trap said member within said cavity;

consolidating said pair of components and said ceramic fiber/metal matrix member to form a workpiece unitary body of continuous metallic matrix; and forming said unitary body to a desired external configuration to define said rotor member.

3. A ceramic fiber/matrix composite member made according to the method of claim 1.

4. A unitary metallic rotor member including an integral reinforcing portion of ceramic fiber/metal matrix composite made according to the method of claim 2.

5. A method of making unidirectional ceramic fiber/metal matrix composite sheet material comprising the steps of: orienting elongate ceramic filaments into substantially parallel coplanar relationship to define an elongate planar ceramic fiber mat having a single coplanar layer of said filaments; providing a pair of elongate planar metallic foils, sandwiching said ceramic fibermat between said pair of foils, and consolidating said pair of metallic foils with said ceramic fiber mat to define as a unitary body said composite sheet material, wherein:

said step of orienting elongate ceramic filaments into substantially parallel coplanar relationship to define said elongate planar ceramic fiber mat comprises the steps of providing a cylindrical radially outwardly disposed and axially extending surface, helically winding onto said cylindrical surface multiple spaced apart windings of an elongate ceramic filament progressively axially across said surface with adjacent ones of said filament windings being substantially parallel, providing a removable binder matrix material to said windings and cylindrical surface, cutting said windings along an axially extending line to define a mat of multiple elongate substantially parallel ceramic filaments bound in said binder matrix, and removing said mat from said cylindrical surface intact with said binder matrix; and wherein said step of consolidating said pair of metallic foils and said sandwiched ceramic fiber mat comprises the steps of providing an impermeable membrane, sealingly enclosing said pair of metallic foils and said sandwiched ceramic fiber mat within said impermeable membrane, removing said binder matrix; and employing heat, pressure applied perpendicularly to the plane of said pair of metallic foils and said sandwiched ceramic fiber mat, and time sufficient to effect consolidation.

6. The method of claim 5 further including the steps of employing cured acrylic as said binder matrix material, removal of said binder matrix material including the steps of elevating the temperature thereof to approximately 1000° F., employing said elevated temperature to decompose said binder matrix material to volatile and/or gaseous decomposition products, and employing a partial vacuum to withdraw said decomposition products from within said impermeable membrane.

7. The method of claim 6 wherein said step of applying heat pressure, and time to effect consolidation of said pair of metallic foils and said sandwiched ceramic fiber mat includes the steps of applying heat to effect a temperature of from 1650° F. to 1750° F., applying pressure sufficient to effect a unit force of from 6000 pounds per square inch (6 KSI) to 10 KSI, and maintaining said temperature and pressure for a time period of from 20 minutes to 45 minutes.

8. The method of making a unidirectional elongate ceramic fiber/metal matrix composite ribbon member including the steps of: making unidirectional ceramic fiber/metal matrix composite sheet material according to the method of claim 5, and slitting said sheet material along a line parallel with the elongate ceramic filaments therein to separate said ribbon member from a remainder of said sheet material.

9. The method of making a composite annular body of ceramic fiber/metal matrix with multiple ceramic fibers extending circumferentially and a continuous metal matrix comprising the steps of:

providing an elongate ceramic fiber/metal matrix composite ribbon member according to claim 8;

spirally winding said ribbon upon itself to form an annular hoop form having multiple successive overlying wraps of said ribbon extending circumferentially therein; and consolidating said hoop form into a unitary body having a continuous metallic matrix and multiple circumferentially extending ceramic fibers disposed within said metallic matrix.

10. The method of making a unitary disk-like rotor member having an integral composite ceramic fiber/metal matrix reinforcing portion and a metallic infrastructure which is continuous axially, radially and circumferentially throughout said rotor member, said method comprising the steps of forming a composite annular body of ceramic fiber/metal matrix according to claim 9; forming said composite body to a determined outer shape; providing a pair of monolithic metallic rotor member components cooperatively defining a cavity closely matching said determined shape of said composite body; assembling said pair of rotor member components with said composite body within said cavity; sealingly uniting said pair of rotor member components to trap said composite body in said cavity, consolidating said pair of rotor member components and said composite body to define a unitary rotor member workpiece, and finish forming said rotor member workpiece to define said disk-like rotor member.

11. Unidirectional ceramic fiber/metal matrix composite sheet material made according to the method of claim 5.

12. A unidirectional elongate ceramic fiber/metal matrix composite ribbon member made according to the method of claim 8.

13. A composite annular body of ceramic fiber/metal matrix made according to the method of claim 9.

14. A unitary disk-like rotor member having an integral composite ceramic fiber/metal matrix reinforcing portion and a metallic infrastructure which is continuous throughout said rotor member made according to the method of claim 10.

* * * * *